US006582260B2

(12) United States Patent
Nemoto et al.

(10) Patent No.: US 6,582,260 B2
(45) Date of Patent: Jun. 24, 2003

(54) OUTBOARD ENGINE ASSEMBLY

(75) Inventors: Hideki Nemoto, Wako (JP); Shoichi Rinzaki, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/938,369

(22) Filed: Aug. 24, 2001

(65) Prior Publication Data

US 2002/0025740 A1 Feb. 28, 2002

(30) Foreign Application Priority Data

Aug. 25, 2000 (JP) ..... 2000-255290
Aug. 25, 2000 (JP) ..... 2000-256142
Jul. 2, 2001 (JP) ..... 2001-201364

(51) Int. Cl.[7] ..... B63H 20/32; B63H 21/10
(52) U.S. Cl. ..... 440/77; 440/88 A
(58) Field of Search ..... 440/76, 77, 88

(56) References Cited

U.S. PATENT DOCUMENTS 2,224,900 A * 12/1940 Conover ..... 440/77
4,522,602 A * 6/1985 Okazaki ..... 440/77
4,692,123 A * 9/1987 Tada et al. ..... 440/77
5,340,343 A * 8/1994 Kawamukai et al. ..... 440/77
5,445,547 A * 8/1995 Furukawa ..... 440/77
5,873,755 A * 2/1999 Takahashi et al. ..... 440/77
5,957,100 A * 9/1999 Frohwerk et al. ..... 123/90.37
6,095,877 A * 8/2000 Kawamukai et al. ..... 440/77
6,183,323 B1 * 2/2001 Tanaka et al. ..... 440/77

FOREIGN PATENT DOCUMENTS

JP 05306633 11/1993
JP 06016187 1/1994
JP 06033790 2/1994
JP 10184377 7/1998
JP 11198893 7/1999

* cited by examiner

*Primary Examiner*—S. Joseph Morano
*Assistant Examiner*—Andrew Wright
(74) *Attorney, Agent, or Firm*—Adams & Wilks

(57) ABSTRACT

An outboard engine assembly is provided for dividing an engine room into two room sections with a sealing property to protect an air intake system from being adversely affected with heat generated by an exhaust system. The outboard engine assembly has a wall means serving as a partition wall to divide the engine room into two room sections. The wall means has a profile formed in a thick string which is placed between an outer side wall of a cylinder head cover and an inner side wall of an engine cover. In one of the two room sections, the air intake system is located for supplying intake air to a combustion chamber of an engine from outside. In the other one of the two room sections, the exhaust system is located for expelling exhaust emissions outside from the engine.

29 Claims, 6 Drawing Sheets

OUTBOARD ENGINE ASSEMBLY

BACKGROUND OF THE INVENTION

1. Field of the Invention

This invention relates to an outboard engine assembly wherein an engine room concealed by an engine cover is divided into a heat-side room section and an air-intake-side room section.

2. Description of the Related Art

Various outboard engine assemblies employing a V-type engine which meets a demand for discharging exhaust emissions at a large flow rate to provide an increased engine power output while attaining miniaturization of an external size of the engine are known. A typical example of such engine assemblies is disclosed in Japanese Patent Laid-Open Publication No. HEI-5-30663.

Generally, the outboard engine assembly equipped with an engine functions to intake air in an engine room which is defined with an engine cover. Accordingly, the surrounding temperature in the engine room is adversely affected with the temperature of intake air, resulting in a decrease in engine power output or causing a difficulty in startup of the engine.

To address this issue, it has been proposed to employ a partition plate in the outboard engine assembly for separating intake air from a heat source, as disclosed in Japanese Patent Laid-Open Publication No. HEI-6-016187.

The outboard engine assembly, disclosed in Japanese Patent Laid-Open Publication No. HEI-6-016187, has the partition plate which defines an internal space in an engine cover receiving the engine into a main space and a sub space which are aligned in fore and aft direction in the outboard engine assembly. The sub space receives a throttle body, and the main space receives major part of the engine. The sub space communicates with an air intake port formed at a front portion of the engine cover for combustion. Consequently, the outboard engine assembly is designed on the assumption that an air intake system is located in front of a crankcase, with a resultant difficulty caused in applying such a concept in the aforementioned V-type engine.

In recent years, outboard engine assemblies having an alternating-current generator (alternator) driven by a crankshaft through a belt are now widely used on boats. It has been proposed to provide an outboard engine assembly with a watertight cover which conceals the generator to prevent entry of water from the outside air introducing port formed in the engine cover for combustion, as known for example from Japanese Patent Laid-Open Publication No. HEI-6-33790. The generator is located at an area remotest from the air intake system.

In the aforementioned outboard engine, however, the absence of consideration of hot air produced by the generator leads to a difficulty in effectively cooling the alternating-current generator. In the halt state of the engine, further, hot air is filled in the watertight cover and the engine room, causing hot air to be undesirably sucked into the engine due to intake vacuum produced during re-startup of the engine.

With such an engine room having a narrow space, mounting the alternating-current generator in a position separated from air flow directed to the intake air introducing port of the engine undergoes an issue to restrict the freedom in designing the outboard engine assembly. In contrast, simply increasing the engine room with a view to separating the generator from the aforementioned air flow encounters another problem caused in a large size of the outboard engine assembly.

To address these issues, it has been proposed to provide an outboard engine assembly wherein the alternating-current generator is located in a midway of an air flow passage leading from the intake air introducing port formed in the engine cover and the air intake system in order to effectively cool the generator, as suggested by Japanese Patent Laid-Open Publication Nos. HEI-10-184377 and HEI-11-198893 filed by the applicant of this application.

SUMMARY OF THE INVENTION

It is therefore an object of the present invention to provide an outboard engine assembly having an effective engine room structure, suited for use in an engine wherein a crankcase and an intake air introducing port are separated from one another, and an outboard engine structure of the V-type engine.

According to a first aspect of the present invention, there is provided an outboard engine assembly which comprises an engine having a cylinder block with at least one cylinder forming part of a combustion chamber, a cylinder head, a cylinder head cover and a crankcase accommodating a crankshaft in vertical orientation, an engine cover located so as to cover a periphery of the engine and forming an engine room or engine compartment which receives the engine, an air intake passage communicating the engine room with the combustion chamber, wall means located at an outer side area of the cylinder head cover and dividing the engine room into a least two room sections, an engineroomside communicating section connected to the air intake passage located in one of the room sections divided by the wall means, and exhaust means located in another one of the room sections divided by the wall means and communicating with the combustion chamber.

With such a feature of the present invention, the wall means, which constitutes a partition wall to divide the engine room, utilizes a flat portion of an outer wall surface of the cylinder head cover, with a resultant ease of installation of the wall means (wall partition). The presence of the wall means makes it possible to reliably divide the engine room for thereby effectively lowering the temperature of intake air. Since the wall means is simply placed between an outer wall surface of the cylinder head cover and an inner wall surface of the cylinder cover, the wall means has a reduced number of component parts and makes it possible to adopt a thick string made of urethane rubber or sponge with a circular cross section. Thus, the wall means per se has a sealing property, making it unnecessary to use an extra sealing member such as a partition plate.

In particular, even in the engine wherein the crankcase and the intake air introducing port are separated from one another, the division of the engine room is reliably ensured with the wall means such that, especially in the V-type engine, the air intake unit is located in the V-bank to reliably ensure the engine room to be divided into fore and aft room sections.

In a preferred form, the engine assembly employs the V-type engine wherein the aforementioned cylinder blocks are configured in the V-shape. Locating the wall means, which constitutes the partition wall, by utilizing the outer sides expanded in the V-shape of the V-type engine requires a decreased amount of extension (which is not a vertical length but is the amount of protrusion in the engine room). Specifically, in a case of the engine cover which is configured in a deeply shaped bowl profile facing downward, the presence of the wall means having the reduced extension enables the production in an easy manner. In the outboard engine assembly mounted with the V-type engine, further, the location of the air intake unit in the V-bank ensures the division of the engine room in the fore and aft room sections. Consequently, in the outboard engine assembly mounted with the V-type engine, it is possible to effectively lower the temperature of intake air.

Preferably, the cylinder head cover is composed of a material such as, for example, a plastic resin. With the cylinder head cover made of plastic material, it is possible to minimize the wear of the engaging portions (abutting engagement portions) of the cylinder head cover relative to the wall means owing to the vibrations of the engine. Also, while a cam chamber is defined by the cylinder head having a heat and the cylinder head cover, the presence of the cylinder head cover made of plastic material eliminates the amount of heat transfer from the cylinder head side, with a resultant increase in the performance of lowering the temperature of intake air.

It is desirable that the intake air silencer is located in the intake air passage above the cylinder block. Location of the intake silencer at an area above the engine enables the wall means to provide an efficient sealing effect with the use of a relatively flat surface of the intake silencer. Also, the presence of the intake silencer located above the engine enables the wall means to be readily extended over an area starting from the starboard side to the port side, providing an ease of locating the wall means as well as ensuring the sealing property.

According to a second aspect of the present invention, there is provided an outboard engine assembly which comprises an engine having a cylinder block with at least one cylinder forming part of a combustion chamber, a cylinder head, a cylinder head cover and a crankcase accommodating a crankshaft in vertical orientation, an engine cover located so as to cover a periphery of the engine and forming an engine room which receives the engine, and wall means located between an engine-room-side communicating section of the intake air passage of the engine, and an alternating-current generator mounted to the engine.

The presence of the wall means, which serves as the partition wall, located between the room section for the alternating-current generator and the room section for the intake air side in the engine room is effective for preventing hot air from entering the air-intake-side, thereby avoiding the location of the generator, to be mounted near the engine, from being restricted in design owing to the flow of intake air to provide an improved freedom in location layout of the alternating-current generator. Further, during the halt condition of the generator, it is possible for the wall means to limit hot air, which remains in the belt cover of the generator, from being transferred to the air intake side. Thus, only consideration has to be undertaken for the technologies for discharging heat from the room section defined at the intake air passage side by the wall means and for taking a measure to achieve cooling operation, thereby preventing the temperature of intake air from being adversely affected with hot air produced by the generator after its operation has been terminated to ensure smooth re-startup of the engine.

Preferably, the engine comprises the V-type engine with the cylinder block configured in the V-shape. The aforementioned wall means divides the engine room into at least two room sections, one of which accommodates the engine-room-side communicating portion of the intake air passage and another one of which accommodates the aforementioned alternating-current generator, with the engine cover having intake air introducing ports at respective room sections.

Thus, the presence of the intake air introducing port for the alternating-current generator improves the freedom in layout of the generator and also enables the generator to be effectively cooled. In addition, since the wall means for dividing the engine room into the two room sections is placed along the outer side periphery of the V-type engine, the outer side periphery of the V-shaped configuration which is expanded can be effectively utilized. As a result, the outward extension (that is not the length in the vertical direction but is the amount of inward protrusion) of the partition wall which is constituted with the wall means is selected to have a small value. Since, further, the amount of extension of the partition wall is small, it is possible to fabricate the engine cover which has a deeply indented and downwardly facing bowl configuration.

In a case where the aforementioned wall means is located along the outer side periphery of the aforementioned cylinder head cover of the engine, the flat surface of the cylinder head cover can be utilized, thereby preferably providing an ease of locating the wall means. The cylinder head cover may be made of, for example, plastic material in the illustrated embodiment of the present invention.

Dividing the aforementioned engine room including the exhaust manifold extending from the cylinder head into the two room sections with the wall means enables the surrounding temperature at the air intake side of the engine room to be totally prevented from being adversely affected with exhaust emissions.

The engine room, which is divided into the two room sections with the wall means, is interconnected at the lower half portion with the intake air side, and the sectional area of the opening of the outside air introducing port of the air intake side is designed to be larger than that of the opening formed at the side of the alternating-current generator. That is, as the amount of fresh air to be sucked at the air intake side increases, the temperature of intake air decreases, making it possible to smoothly suck hot air from the side of the generator.

The outboard engine assembly may include the intake silencer which is located in the intake air passage above the cylinder block. By locating the wall means with the use of the relatively flat surface of the intake silencer, the wall means is effective for improving the sealing property at the divided area of the engine room.

BRIEF DESCRIPTION OF THE DRAWINGS

Certain preferred embodiments of the present invention will be described in detail below, byway of example only, with reference to the accompanying drawings, in which.

DETAILED DESCRIPTION OF THE PREFERRED EMBODIMENTS

Figure 1:
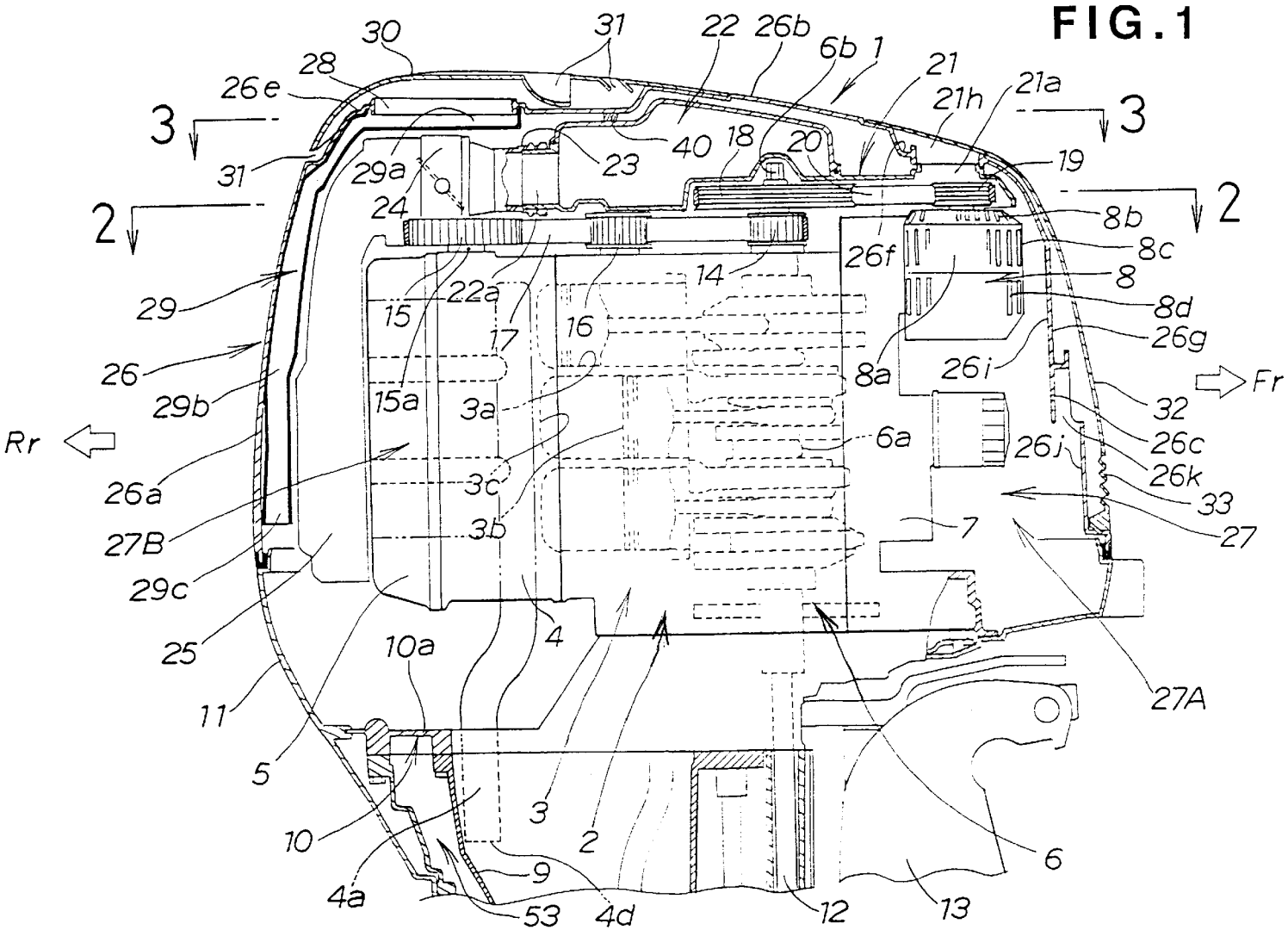
FIG. 1 is a cross sectional view illustrating an upper portion of an outboard engine assembly according to a preferred embodiment of the present invention.

Throughout the drawings, reference character Fr represents a front direction of an outboard engine assembly while reference character Rr represents a rearward direction of the outboard engine assembly.

Referring now to FIGS. 1 to 6, the outboard engine assembly 1 includes an internal combustion engine 2 horizontally located at an upper part of the engine assembly. In the illustrated embodiment, the engine 2 is constructed of a multi-cylinder type structure and includes a cylinder block 3 having a plurality of cylinders 3*a* arranged in a vertical direction on a horizontal plane. Each cylinder 3*a* slidably receives therein a piston 3*b*. A plurality of cylinder heads 4 are coupled to respective rear parts of the cylinder block 23. Cylinder head covers 5 are located at rear ends of the respective cylinder heads 4. A crankcase 7 is connected to a front end of the cylinder block 3. The plurality of cylinders 3*a* and the associated cylinder heads 4 form a plurality of combustion chambers 3*c*.

A skirt portion 6, which accommodates therein a crankshaft 6*a* which extends in a vertical direction when the outboard engine assembly is in an upright position as shown in FIG. 1, is integrally formed with a front side (in close proximity to a frontal portion of the engine assembly) of the cylinder block 3. This skirt portion 6 constitutes a half section of a crank chamber. The crankcase 7 constitutes another half section of the crank chamber. An oil pan 9 is located below the cylinder block 3, the skirt portion 6 and the crankcase 7.

The engine 2 is of a V-type, six-cylinder engine wherein the cylinder block 3 is configured in a V-shape as viewed in a plane in a manner as will be described below in detail.

The engine 2 is supported on a mount case 10, which is located so as to cross inside an under cover 11 which surrounds a lower circumferential periphery of the engine 2.

In lower sections of the cylinder heads 4, an exhaust pipe 4*a* hangs down. The exhaust pipe 4*a* has a lower end 4*d* which is open to a lower portion of the under cover 11 via a traversing partition wall 10*a* of the mount case 10.

A lower end of the under cover 11 is interconnected with an extension case which is not shown, below which a gearbox is located, though not shown. At a rear side of the gearbox, a thruster (screw) is located. A lower end of a crankshaft 6*a*, which extends in a vertical direction, is interconnected to a propeller shaft 12. The propeller shaft 12 extends through the extension case and is coupled to a gear transmission mechanism located inside a gearbox for driving the screw.

In the vicinity of an upper area of the engine 2, a belt pulley mechanism is located for driving a camshaft 15*a* and an alternating-current generator or an alternator 8.

Reference numeral 13 designates a swivel case for mounting the outboard engine assembly 1 in the stern of a boat.

Figure 2:
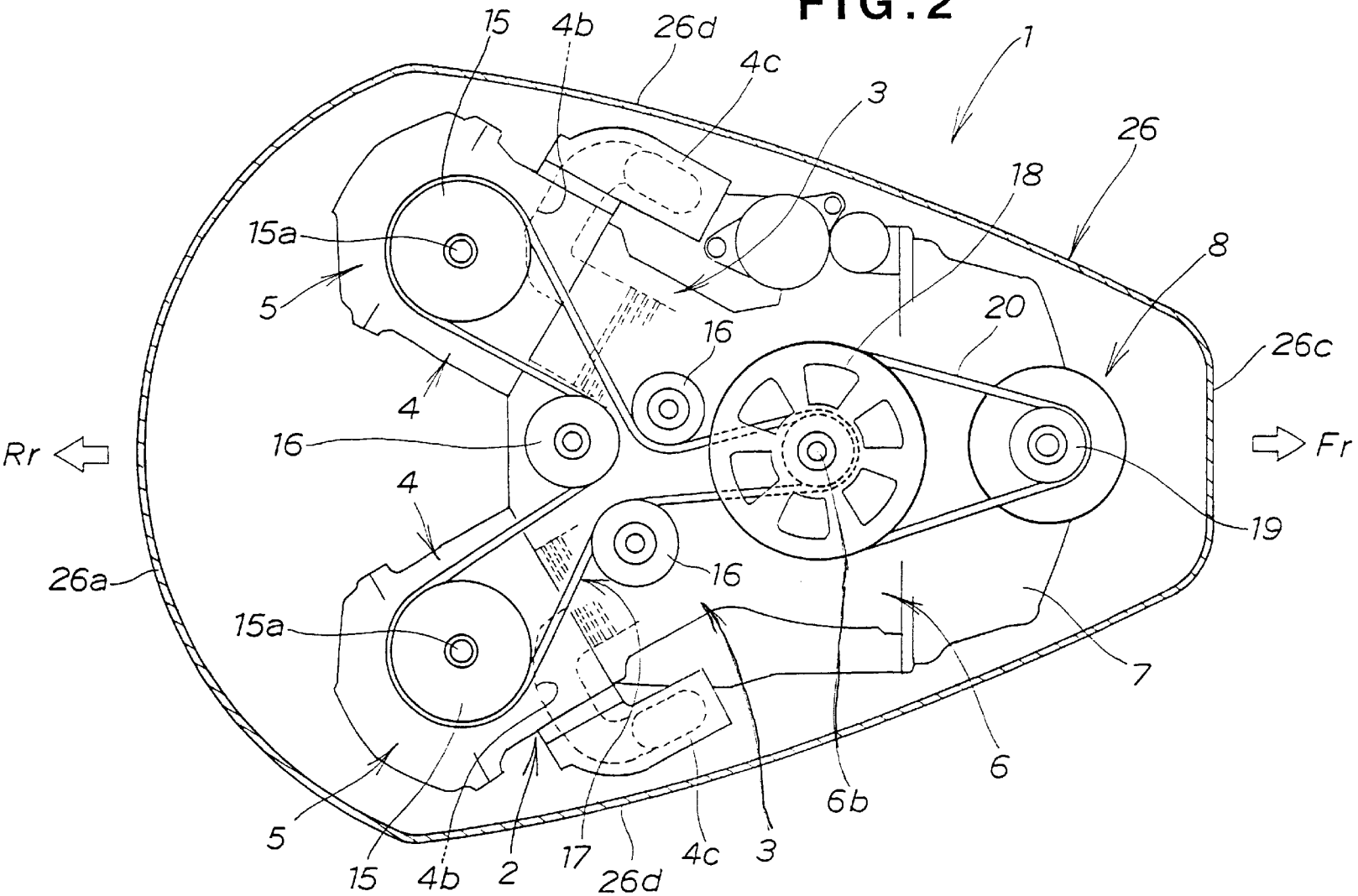
FIG. 2 is a cross-section taken along line 2—2 of FIG. 1.

In an upper area of the cylinder block 3, an upper end 6*b* of the crankshaft 6*a* projects. The upper end 6*b* carries a camshaft drive pulley 14. As shown in FIG. 2, in respective upper areas of the left and right cylinder heads 4, 4, camshaft driven pulleys 15, 15 are located. These camshaft driven pulleys 15, 15 are fixedly mounted to respective upper ends of the camshafts 15*a*, 15*a*. A timing belt 17 is stretched between the camshaft drive pulley 14 and the camshaft driven pulleys 15, 15 via a plurality of intermediate pulleys 16, such as guide pulleys and tension pulleys, etc.

In an upper area of the camshaft drive pulley 14, further, a generator driving pulley 18 of a large diameter is fixedly coupled to an upper end 6*b* of the crankshaft 6*a*. A belt 20 is wound between the pulley 18 and a generator driven pulley 19. Thus, the alternating-current generator 8 is driven by the crankshaft 6*a*.

In the illustrated embodiment of FIG. 1, the alternating-current generator 8 has a plurality of upper slits 8*b* formed on an upper portion of a case body 8*a* for introducing cooling air, a plurality of intermediate slits 8*c* formed at an intermediate portion of the case body 8*a* for exhausting air, and a plurality of lower slits 8*d* formed at a lower portion of the case body 8*a* for introducing cooling air.

In an upper area of the alternating-current generator 8, a belt cover 21 is located for covering the pulleys 18, 19 and the belt 20. The belt cover 21 has an opening portion 21*a* formed at an upper area of the generator driven pulley 19. The belt cover 21 has another upper portion which is located above the generator driving pulley 18 and which forms a part of a rear portion of a bottom wall of an intake silencer 22 which is located above the cylinder block 3.

A communication port 22*a* of the intake silencer 22, which is directed rearward, is coupled to a throttle valve unit 24 via a connecting pipe 23 such as a rubber tube. The throttle valve unit 24 is located above the cylinder heads 4, 4 and the cylinder head covers 5, 5 and in a V-shaped bank (a V-shaped space as viewed in a plane) 50 which is formed between the left and right cylinder heads 4, 4 and the left and right cylinder head covers 5, 5, which are formed in the V-shape configuration.

Figure 3:
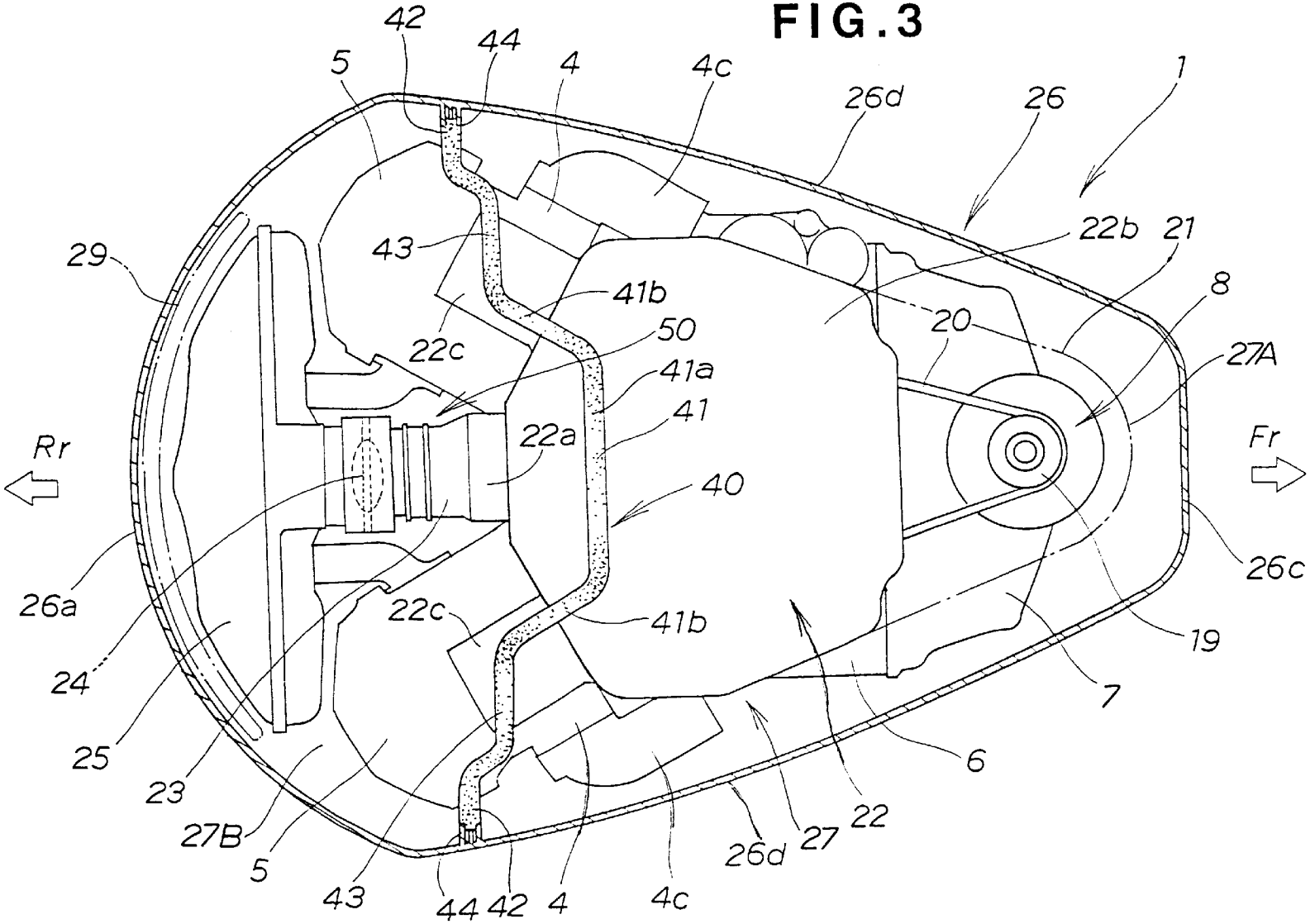
FIG. 3 is a cross-section taken along line 3—3 of FIG. 1.

A downstream end of the throttle valve unit 24 is located at a rear area of the aforementioned V-bank 50 at rear portions of the left and right cylinder head covers 5, 5 as seen in FIGS. 1 and 3. The throttle valve unit 24 is connected to and communicates with an intake manifold 25 which is located in a vertical area formed rearward of the cylinder head cover 5 for distributing and supplying fuel to the aforementioned respective combustion chambers 3*c*.

Figure 4:
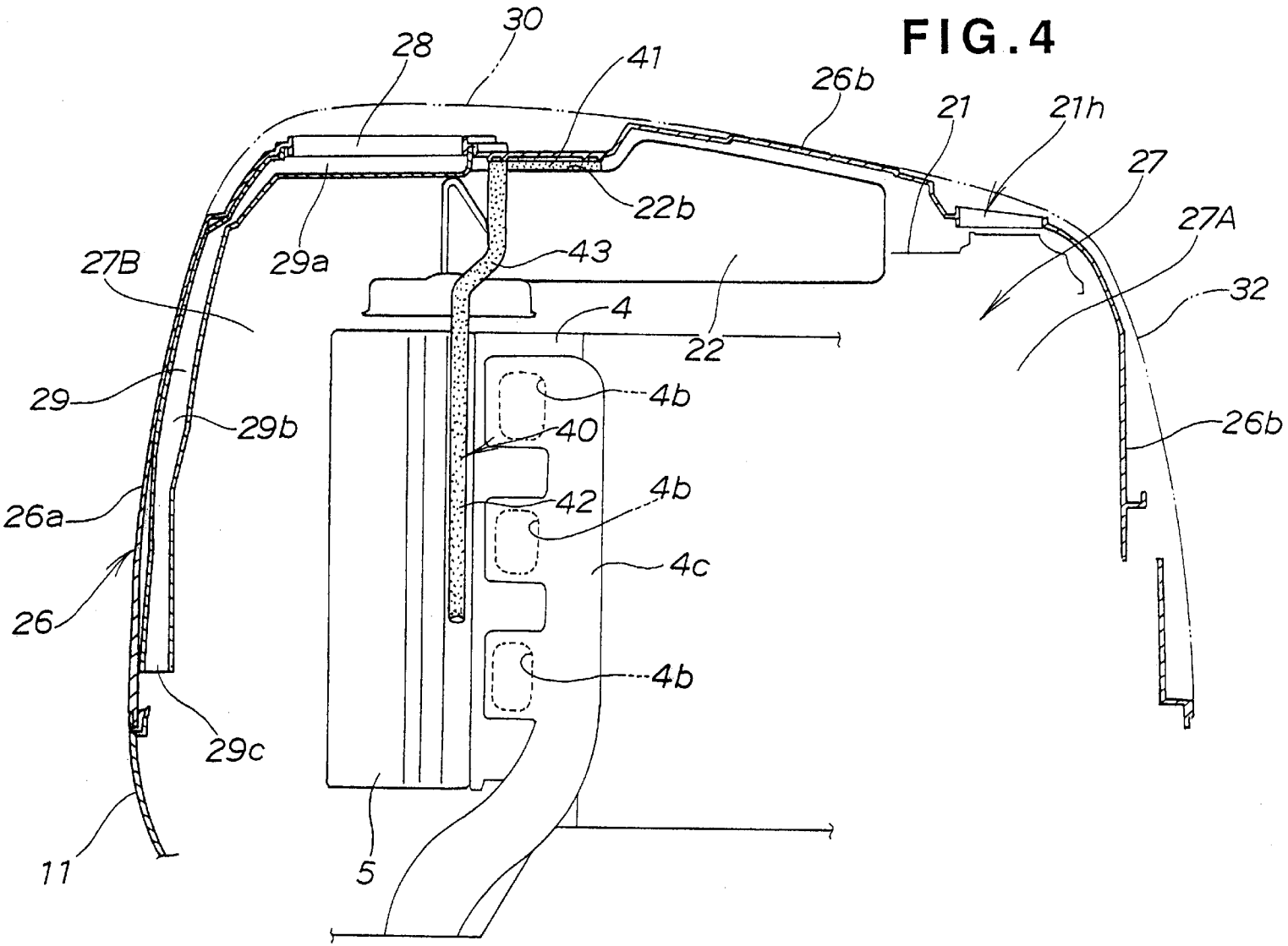
FIG. 4 is an enlarged cross-sectional view illustrating a relation among an air intake system, a wall means and an exhaust manifold.
Figure 5:
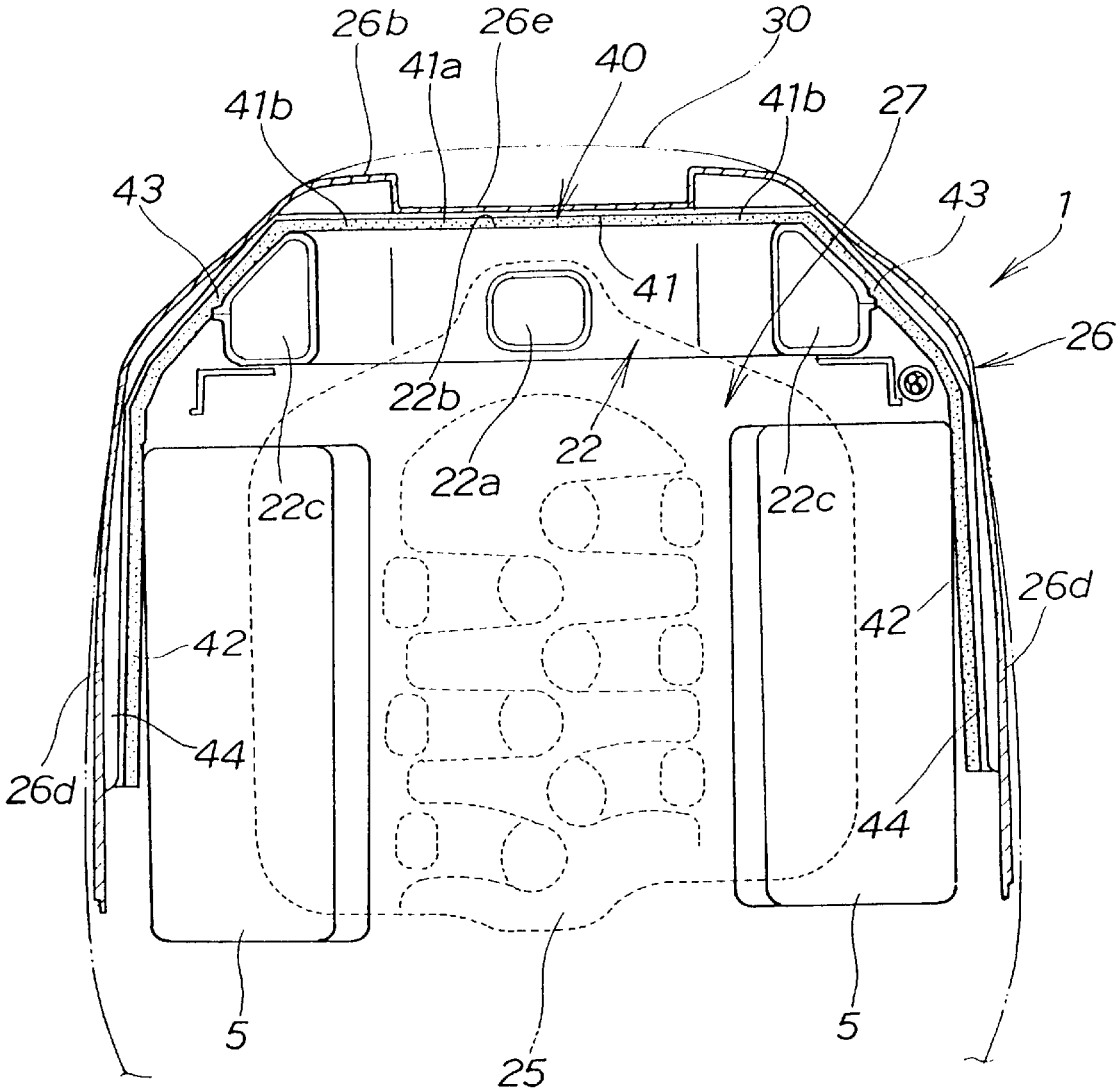
FIG. 5 is a cross-sectional view illustrating the upper portion of the engine assembly, as seen from a left side, with an engine cover of FIG. 2 cut away.
Figure 6:
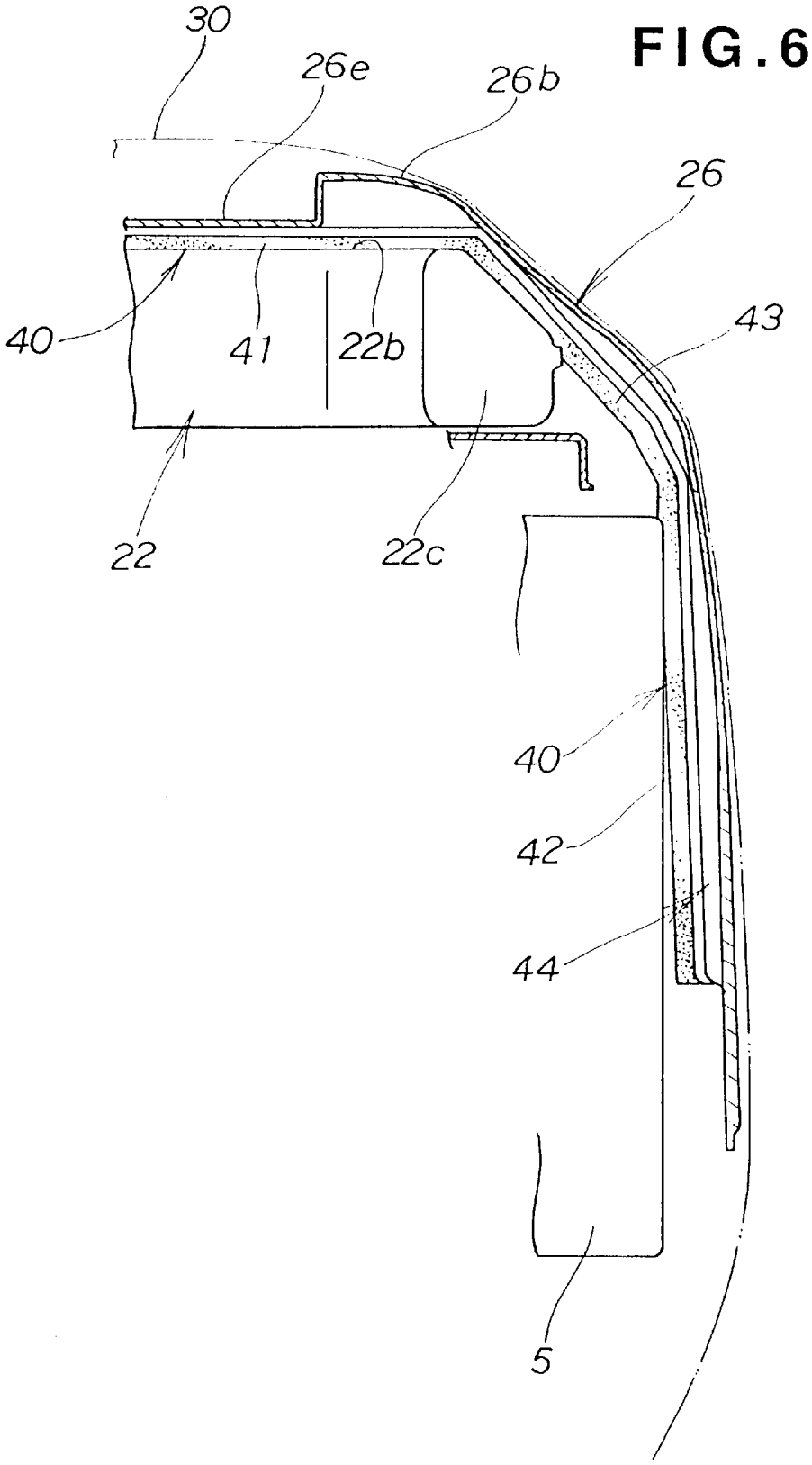
FIG. 6 is a view illustrating on an enlarged scale part of FIG. 5.

As shown in FIGS. 3 to 5, the intake silencer 22 has bifurcated left and right intake ports 22*c*, 22*c*, which face rearward, and the communication port 22*a* connected between the intake ports 22*c*, 22*c* and the throttle valve unit 24. The left and right intake ports 22*c*, 22*c* function as a communicating section of the engine room via an intake passage (an intake system) for introducing outside air, which is drawn into the engine room from an outside air introduction port 28 via an intake air guide 29. That is, the aforementioned intake ports 22*c*, 22*c* form the communicating section for communicating the outside air introduction port 28 with the respective combustion chambers 3*c*.

The engine cover 26, which forms an outer case of the outboard engine assembly, conceals the aforementioned engine 2 and its peripheral component parts and defines the engine room 27. The engine cover 26 includes a rear cover component 26*a*, an upper cover component 26*b*, a front cover component 26*c*, and left and right side cover components 26*d*, 26*d*.

A rear end of the upper cover component 26*b* of the engine cover 26 has a concave portion 26*e* formed with the outside air introduction port 28 for introducing outside air. The outside air introducing port 28 communicates with an air intake port 29*a* of the intake air guide 29 which is formed along an inner surface of of the rear cover component 26*a* of the engine cover 26. The intake air guide 29 is located between a rear surface of the intake manifold 25 and an inner side wall of the rear cover component 26*a* of the engine cover 26. The intake air guide 29 has an air guide passage 29*b* which forms an intake passage and which extends downward along the inner side wall of the rear cover component 26*a* of the engine cover 26 and has a lower opening portion 29*c* which opens downward.

The concave portion 26*e* formed at the rear portion of the upper cover component 26*b* of the engine cover 26 is concealed with a top cover 30. Rear and upper portions of the top cover 30 have a plurality of slits 31 for introducing outside air.

Recessed step portions 26*f* and 26*g* are formed in areas covering the front section of the upper cover component 26*b* and the front cover component 26*c* of the engine cover 26, respectively. The recessed step portion 26*f* is formed with an opening portion 21*h* which communicates with the opening 21*a* of the belt cover 21. The recessed step portion 26*g* has two vertical walls 26*i*, 26*j* which are spaced from one another in fore and aft directions. The vertical walls 26*i*, 26*j* form a labyrinth 26*k*.

Outsides of the recessed step portions 26*f*, 26*g* are covered with a front cover 32. A lower portion of the front cover 32 has a plurality of slits 33 for introducing outside air. Outside air, which is drawn from the slits 33, passes through the labyrinth 26*k* into the engine room 27 for cooling the alternating-current generator 8.

Further, the outside air is introduced into the engine cover 26 through the slits 31 formed in the rear cover component 26*a* and the slits 31 formed in the upper cover component 26*b*, of the engine cover 26, and is introduced into the engine room 27 via the outside air introducing port 28 and the intake air guide 29. The intake air guide 29 is directed upward and downward and has an extended longitudinal length and, hence, water droplets such as sea water droplets drop downward to be exhausted through the lower opening portion 29*c*. In contrast, air is sucked into the intake silencer 22 located in the upper area and is supplied to a fuel system.

Since the passage area covering the outside air introducing port 28 and the intake air port 29*a*, which corresponds to a substantial introducing port of the engine room, of the intake air guide 29 is larger than that of the plural slits 33 of the cover 32, the respective combustion chambers 3*c* are supplied with an increased amount of intake air for combustion purposes, with a resultant decrease in the temperature of the intake air.

A wall means or partition 40 is mounted to an inner circumferential periphery covering the fore and aft portions and the intermediate portion of the engine cover 26 and is also mounted between the engine cover 26 and the inwardly installed component parts. The wall means or partition 40 divides a major vertical portion of the engine room 27 (i.e., a portion from the top of the engine room to near the bottom thereof) into a front room section 27A and a rear room section 27B.

The wall means or partition 40 (referred to hereinafter as simply wall means) divides the engine room 27 in the fore and aft room sections, which are sealed from one another. In the illustrated embodiment, the wall means 40 is made of an elongated material formed in a thick string with a circular cross section as shown, for example, in FIG. 4. The wall means 40 is made of resilient material such as urethane rubber or sponge having a high sealing performance. The wall means 40 may be formed of a tubular material having an increased flexural property.

As seen in FIG. 5, the wall means 40 is configured in a U-shape profile in an inverted state. The wall means 40 is composed of an uppermost string component 41, left and right side string components 42, 42 and upper sidewise slanted string components 43, 43 which are symmetrically formed and each of which is formed between the uppermost string component 41 and the side string component 42.

The wall means 40 is located such that the uppermost string component 41 is placed on an upper surface 22*b* of the intake silencer 22. In particular, the uppermost string component 41 is sandwiched between a lower surface of a recessed portion 26*e* formed in an upper cover wall 26*b* of the engine cover 26, and an upper wall 22*b* of the intake silencer 22. With such a sandwiched structure, the wall means 40 also functions as a sealing member such as an O-ring.

As viewed in FIG. 3, the uppermost string component 41 of the wall means 40 has a central portion 41*a* shaped in a profile which protrudes in the forward direction and which extends so as to cross the engine room 27 in a widthwise direction. Both side portions 41*b*, 41*b* of the central portion 41*a* are slanted so as to spread toward the left and right side wall covers 26*d*, 26*d* and are interconnected to sidewise upper string portions 43, 43.

As best shown in FIG. 4, the left and right side string components 42, 42 are located at positions rearward of the uppermost string component 41. The side string components 42, 42 are located in areas along outer walls of the left and right cylinder head covers 5, 5 of the engine 2 as seen in FIG. 5.

Both ends of the side string components 42, 42 of the wall means 40 are held in engagement with recessed parts 44, 44 formed on inside walls of the left and right side covers 26*d*, 26*d* of the engine cover 26.

As already discussed above, the wall means 40 is interposed between an outer surface of the upper wall 22*b* of the intake silencer 22 of the engine 2, the outer surface or side walls of the cylinder head covers 5, 5 and the inner surface or wall of the engine cover 26.

The lower ends of the side string components 42, 42 of the wall means 40 are formed so as to extend toward areas in the vicinities of respective intermediate lower portions of the cylinder head covers 5, 5. Preferably, the lower end of each side string component 42 is formed so as to extend toward an area near the exhaust passage 4*b* at the lowermost end of the exhaust manifold 4*c* which serves as a heat source as will be described below in detail. The exhaust pipe 4*a,* which remains outside the engine room in FIG. 1, protrudes downwardly toward an area near the lower end portions of the side string components 42, 42 of the wall means 40.

Respective exhaust pipes 4*a* protrude outward of the cylinder heads 4, 4 located forwardly of the cylinder head covers 5, 5. As shown in FIGS. 2 and 4, the respective exhaust passages 4*c*, 4*c* of the cylinder heads 4, 4 are connected to the exhaust manifolds 4*c*, 4*c* which serve as exhaust means of the engine room 27. The lower end 4*d* of the respective exhaust pipes 4*a*, which serves as the exhaust means of the engine room 27 and which hang down from the respective exhaust manifolds 4*c*, 4*c* so as to communicate downward, extends through the mount case 10 which is located so as to cross the under cover 11 into an exhaust expansion chamber 53 formed internally in a lower half of the under cover 11. The mount case 10 forms the engine room 27 and the exhaust expansion chamber 53 which are located in upper and lower positions, respectively.

The engine room 27 defined above the mount case 10 which extends across the under cover 11, is divided into front and rear room sections 27A, 27B by means of the wall means 40. Within the rear room section 27B, which is defined with the wall means 40, the air intake system connected to the intake air passage of the engine is located, and the alternating-current generator 8 is located in the front room section 27A.

Since the front room section 27A and the rear room section 27B are sealed from one another by means of the wall means 40 to form independent room sections, hot air produced by remaining heat of the generator 8 in the front room section 27A is prevented from entering the rear room section 27B located in the air intake side, thereby preventing an increase in the surrounding temperature of the rear room section 27B at the air intake side. Accordingly, it is possible to start up the engine in a smooth and reliable manner.

Upon consideration of engaging and sealing properties relative to the wall means 40, although the cylinder head covers 5, 5 are preferably made of plastic resin in the illustrated embodiment, the present invention is not limited thereto and the covers 5, 5 may be made of metallic material.

The intake ports 22*c*, 22*c* of the intake silencer 22 are open to the rear room section 27B which is defined with the wall means 40 as seen in FIG. 3. The intake silencer 22 is located at the uppermost position of the engine cover 26. The exhaust manifolds 4*c*, 4*c*, which serve as the heat source, are separated from the aforementioned air intake system by means of the wall means 40. The exhaust pipe 4*a* extends downward and is located to be exposed outside the engine room. As a result, the rear room section 27B is not adversely affected with the heat of the exhaust manifold 4*c*, thereby restricting an increase in the temperature of the intake air. Further, the intake ports 22*c*, 22*c* of the intake silencer 22 are separated from the generator 8 which serves as one of the heat sources, thereby preventing the intake air from being adversely affected with the heat of the alternating-current generator 8.

Since the wall means 40 is made of the thick string, which has the sealing function such as the O-ring, the presence of the engine cover 26 made of plastic resin whereas the air intake silencer 22 and the cylinder head cover 5 are made of plastic resin allows the sealing portion from wearing due to vibrations caused by engine vibrations, etc., while preventing heat transfer in a reliable manner.

Obviously, various minor changes and modifications of the present invention are possible in the light of the above teaching. It therefore to be understood that within the scope of the appended claims, the invention may be practiced otherwise than as specifically described.

What is claimed is:

1. An outboard engine assembly comprising:

an engine having a cylinder block with at least one cylinder forming part of a combustion chamber, a cylinder head, a cylinder head cover and a crankcase accommodating a crankshaft in a vertical orientation when the outboard engine assembly is in an upright position;

an engine cover provided so as to cover a periphery of the engine and forming an engine room for accommodating the engine, the engine cover having an outside air introducing port for introducing outside air into the engine room, the outside air introducing port being disposed closer to the cylinder head cover than to the crankcase;

an air intake system disposed in the engine room for introducing outside air from the engine room to the combustion chamber;

exhaust means for discharging exhaust gas from the combustion chamber to the outside of the engine room; and wall means disposed between an outer surface of the cylinder head cover and an inner surface of the engine cover for dividing the engine room into at least two room sections that are sealed from one another; wherein the outside air introducing port is connected with one of the room sections divided by the wall means, the air intake system has an intake port opening to said one of the room sections, and the exhaust means is disposed in another one of the room sections divided by the wall means.

2. An outboard engine assembly according to claim 1; wherein the engine comprises a V-type multi-cylinder engine having at least one pair of cylinder heads and a corresponding number of pairs of cylinder head covers that are arranged in a V-shape so as to define therebetween a generally V-shaped space, and wherein the air intake system includes a throttle valve unit disposed in a position vertically aligned with the V-shaped space and located above the cylinder heads and cylinder head covers, the throttle valve unit being disposed in said one of the room sections.

3. An outboard engine assembly according to claim 1; wherein the cylinder head cover is made of a plastic resin.

4. An outboard engine assembly according to claim 1; wherein the air intake system further includes an air intake silencer disposed in the engine room above the cylinder block, the air intake silencer having an intake port forming the intake port of the air intake system, and wherein the wall means includes a portion disposed between an outer surface of the air intake silencer and the inner surface of the engine cover.

5. An outboard engine assembly according to claim 1; wherein the wall means comprises a string of elongated material having a circular cross section.

6. An outboard engine assembly according to claim 1; wherein the wall means is made of an elastic material having a high sealing property.

7. An outboard engine assembly according to claim 6; wherein the elastic material comprises urethane rubber.

8. An outboard engine assembly according to claim 6; wherein the elastic material comprises sponge.

9. An outboard engine assembly comprising:

a V-type multi-cylinder engine having a cylinder block with a plurality of cylinders, at least one pair of cylinder heads and a corresponding number of pairs of cylinder head covers arranged in a V-shape, the cylinders and cylinder heads forming a plurality of combustion chambers, and a crankcase accommodating a crankshaft in a vertical orientation when the outboard engine assembly is in an upright position;

an engine cover provided so as to cover a periphery of the engine and forming an engine room accommodating the engine, the engine cover having an outside air introducing port for introducing outside air into the engine room, the outside air introducing port being disposed closer to the cylinder head cover than to the crankcase;

an air intake system disposed in the engine room for introducing outside air from the engine room to the combustion chamber, the air intake system having an intake port opening to the engine room so that outside air introduced via the outside air introducing port into the engine room is taken into the air intake system;

an alternating-current generator mounted to the engine and connected to be driven by the crankshaft of the engine; and wall means located between the intake port of the air intake system and the alternating-current generator mounted to the engine, the wall means being disposed between an outer surface of the cylinder head cover of the engine and an inner surface of the engine cover so as to divide the engine room into at least two room sections that are sealed from one another, the intake port of the air intake system opening to one of the at least two room sections, the alternating-current generator being disposed in another one of the at least two room sections, and the outside air introducing port of the engine cover being connected with said one of the at least two room sections.

10. An outboard engine assembly according to claim 9; wherein each cylinder head cover is made of plastic resin.

11. An outboard engine assembly comprising:

a V-type multi-cylinder engine having a cylinder block with a plurality of cylinders, at least one pair of cylinder heads and a corresponding number of pairs of cylinder head covers arranged in a V-shape, the cylinders and cylinder heads forming a plurality of combustion chambers, and a crankcase accommodating a crankshaft in a vertical orientation when the outboard engine assembly is in an upright position;

an engine cover provided so as to cover a periphery of the engine and forming an engine room accommodating the engine, the engine cover having an outside air introducing port for introducing outside air into the engine room, the outside air introducing port being disposed closer to the cylinder head cover than to the crankcase;

an air intake system disposed in the engine room for introducing outside air from the engine room to the combustion chamber, the air intake system having an intake port opening to the engine room so that outside air introduced via the outside air introducing port into the engine room is taken into the air intake system, and an intake silencer disposed in the engine room above the cylinder block, the air intake silencer having two intake ports forming the intake port of the air intake system, the two intake ports being arranged in a bifurcated configuration conforming to the V-shape arrangement of the cylinder heads and the cylinder head covers;

an alternating-current generator mounted to the engine and connected to be driven by the crankshaft of the engine; and wall means located between the intake port of the air intake system and the alternating-current generator mounted to the engine, the wall means dividing the engine room into at least two room sections, the intake port of the air intake system opening to one of the at least two room sections, the alternating-current generator being disposed in another one of the at least two room sections, and the outside air introducing port of the engine cover being connected with said one of the at least two room sections, the wall means including a portion disposed between an outer surface of the intake silencer and the inner surface of the engine cover.

12. An outboard engine assembly comprising:

an engine having a cylinder block with at least one cylinder forming part of a combustion chamber, a cylinder head, a cylinder head cover and a crankcase accommodating a crankshaft in a vertical orientation when the outboard engine assembly is in an upright position;

an engine cover provided so as to cover a periphery of the engine and forming an engine room accommodating the, engine, the engine cover having an outside air introducing port for introducing outside air into the engine room, the outside air introducing port being disposed closer to the cylinder head cover than to the crankcase;

an air intake system disposed in the engine room for introducing outside air from the engine room to the combustion chamber, the air intake system having an intake port opening to the engine room so that outside air introduced via the outside air introducing port into the engine room is taken into the air intake system;

an alternating-current generator mounted to the engine and connected to be driven by the crankshaft of the engine; and wall means located between the intake port of the air intake system and the alternating-current generator mounted to the engine, the wall means comprising a string of elongated material having a circular cross section.

13. An outboard engine assembly comprising:

an engine having a cylinder block with at least one cylinder forming part of a combustion chamber, a cylinder head, a cylinder head cover and a crankcase accommodating a crankshaft in a vertical orientation when the outboard engine assembly is in an upright position;

an engine cover provided so as to cover a periphery of the engine and forming an engine room accommodating the engine, the engine cover having an outside air introducing port for introducing outside air into the engine room, the outside air introducing port being disposed closer to the cylinder head cover than to the crankcase;

an air intake system disposed in the engine room for introducing outside air from the engine room to the combustion chamber, the air intake system having an intake port opening to the engine room so that outside air introduced via the outside air introducing port into the engine room is taken into the air intake system;

an alternating-current generator mounted to the engine and connected to be driven by the crankshaft of the engine; and wall means located between the intake port of the air intake system and the alternating-current generator mounted to the engine, the wall means being made of an elastic material having a high sealing property, the elastic material comprising urethane rubber.

14. An outboard engine assembly comprising:

an engine having a cylinder block with at least one cylinder forming part of a combustion chamber, a cylinder head, a cylinder head cover and a crankcase accommodating a crankshaft in a vertical orientation when the outboard engine assembly is in an upright position;

an engine cover provided so as to cover a periphery of the engine and forming an engine room accommodating the engine, the engine cover having an outside air introducing port for introducing outside air into the engine room, the outside air introducing port being disposed closer to the cylinder head cover than to the crankcase;

an air intake system disposed in the engine room for introducing outside air from the engine room to the combustion chamber, the air intake system having an intake port opening to the engine room so that outside air introduced via the outside air introducing port into the engine room is taken into the air intake system;

an alternating-current generator mounted to the engine and connected to be driven by the crankshaft of the engine; and wall means located between the intake port of the air intake system and the alternating-current generator mounted to the engine, the wall means being made of an elastic material having a high sealing property, the elastic material comprising sponge.

15. An outboard engine assembly comprising:

a V-type multi-cylinder engine having a cylinder block with a plurality of cylinders, at least one pair of cylinder heads and a corresponding number of pairs of cylinder head covers arranged in a V-shape, the cylinders and cylinder heads forming a plurality of combustion chambers, and a crankcase accommodating a crankshaft in a vertical orientation when the outboard engine assembly is in an upright position;

an engine cover provided so as to cover a periphery of the engine and forming an engine room accommodating the engine, the engine cover having an outside air introducing port for introducing outside air into the engine room, the outside air introducing port being disposed closer to the cylinder head cover than to the crankcase;

an air intake system disposed in the engine room for introducing outside air from the engine room to the combustion chamber, the air intake system having an intake port opening to the engine room so that outside air introduced via the outside air introducing port into the engine room is taken into the air intake system, and an alternating-current generator mounted to the engine and connected to be driven by the crankshaft of the engine; and wall means located between the intake port of the air intake system and the alternating-current generator mounted to the engine, the wall means dividing the engine room into at least two room sections, the intake port of the air intake system opening to one of the at least two room sections, the alternating-current generator being disposed in another one of the at least two room sections, and the outside air introducing port of the engine cover being connected with said one of the at least two room sections;

wherein the V-type multi-cylinder engine has a generally V-shaped space defined between the at least one pair of cylinder heads and corresponding number of pairs of cylinder head covers, and wherein the air intake system includes a throttle valve unit disposed in a position vertically aligned with the V-shaped space and located above the cylinder heads and cylinder head covers, the throttle valve unit being disposed in said one of the room sections.

16. An outboard engine assembly comprising:

an engine cover defining therewithin an engine room and having an air intake port;

an internal combustion engine disposed within the engine room and having a crankshaft that extends generally vertically when the outboard engine assembly is in an upright position, an intake manifold communicating with the air intake port for introducing outside air into the engine, and an exhaust manifold for discharging exhaust emissions from the engine; and a partition interposed between the engine and the engine cover and dividing a major vertical portion of the engine room into front and rear room sections that are sealed from one another, the intake manifold being disposed in the rear room section and the exhaust manifold being disposed in the front room section.

17. An outboard engine assembly according to claims 16; further including an alternating-current generator mounted on the engine and disposed within the front room section.

18. An outboard engine assembly according to claim 16; wherein the partition is composed of elastic material.

19. An outboard engine assembly according to claim 18; wherein the elastic material comprises rubber.

20. An outboard engine assembly according to claim 18; wherein the elastic material comprises sponge.

21. An outboard engine assembly according to claim 18; wherein the partition composed of elastic material engages a portion of the engine made of plastic resin.

22. An outboard engine assembly according to claim 21; wherein the portion of the engine made of plastic resin comprises one or more cylinder head covers.

23. An outboard engine assembly according to claim 16; further including an air intake silencer disposed in the engine room above the engine and interposed in an air flow path between the air intake port and the intake manifold; and wherein the partition has a portion disposed between an outer surface of the air intake silencer and an inner surface of the engine cover.

24. An outboard engine assembly according to claim 23;

wherein the engine has one or more cylinder head covers; and wherein the partition has one or more other portions disposed between an outer surface of the one or more cylinder head covers and the inner surface of the engine cover.

25. An outboard engine assembly according to claim 16;

wherein the engine comprises a V-type multi-cylinder engine having a pair of cylinder heads and a pair of cylinder head covers covering respective ones of the cylinder heads; and wherein the partition has an elongate upper component interposed between an upper portion of the engine and an upper portion of the engine cover, and two elongate side components connected respectively to opposite ends of the upper component and extending downwardly between side portions of the engine cover and respective ones of the cylinder head covers.

26. An outboard engine assembly according to claim 25, wherein the partition is composed of elastic material.

27. An outboard engine assembly according to claim 26; wherein the elastic material comprises rubber.

28. An outboard engine assembly according to claim 26; wherein the elastic material comprises sponge.

29. An outboard engine assembly according to claim 26; wherein the cylinder head covers are made of plastic resin.

* * * * *